US007179158B2

(12) United States Patent
Mastrobattista

(10) Patent No.: US 7,179,158 B2
(45) Date of Patent: Feb. 20, 2007

(54) BELT SANDER ERASER ATTACHMENT

(76) Inventor: Michael Mastrobattista, 13403 Tiverton Rd., San Diego, CA (US) 92130

( * ) Notice: Subject to any disclaimer, the term of this patent is extended or adjusted under 35 U.S.C. 154(b) by 0 days.

(21) Appl. No.: 11/176,663

(22) Filed: Jul. 7, 2005

(65) Prior Publication Data

US 2007/0010182 A1 Jan. 11, 2007

(51) Int. Cl.
*B24B 23/06* (2006.01)

(52) U.S. Cl. ..... 451/444; 451/355

(58) Field of Classification Search ..... 451/355, 451/443, 444, 72, 56, 415
See application file for complete search history.

(56) References Cited

U.S. PATENT DOCUMENTS

| | | | | |
|---|---|---|---|---|
| 3,085,268 | A * | 4/1963 | Proulx | 15/21.1 |
| 3,535,829 | A | 10/1970 | Dudek | 51/170 |
| 3,812,622 | A | 5/1974 | Parsons | 51/5 |
| 4,109,422 | A | 8/1978 | Parsons | 51/325 |
| 4,293,970 | A | 10/1981 | Bencene et al. | 15/21 D |
| 4,411,106 | A | 10/1983 | Fleckenstein et al. | 51/170 EB |
| 4,438,601 | A | 3/1984 | Olson | 51/262 A |
| 4,720,939 | A * | 1/1988 | Simpson et al. | 451/5 |
| 4,754,579 | A | 7/1988 | Batt | 51/170 EB |
| 4,815,238 | A | 3/1989 | Simpson et al. | 51/135 |
| 5,484,323 | A * | 1/1996 | Smith | 451/10 |
| 6,036,589 | A * | 3/2000 | Reilly et al. | 451/444 |
| 6,159,085 | A | 12/2000 | Hara | 451/451 |

FOREIGN PATENT DOCUMENTS

| | | | |
|---|---|---|---|
| DE | 4218802 | * 12/1993 | 451/355 |

* cited by examiner

*Primary Examiner*—Robert A. Rose
(74) *Attorney, Agent, or Firm*—Steins & Associates, P.C.

(57) ABSTRACT

A Belt Sander Eraser Attachment is disclosed. The attachment is configured to be attached to a conventional belt sander such that it provides the operator with the ability to remove built up sawdust and the like from the sanding belt. The device removably replaces the conventional front handle on a sander and the new handle has functionality as both a handle and an actuator for the belt sander eraser. The eraser actuation is convenient and ergonomically comfortable for the user while the sander is in use.

17 Claims, 5 Drawing Sheets

BELT SANDER ERASER ATTACHMENT

BACKGROUND OF THE INVENTION

1. Field of the Invention

This invention relates generally to power tool accessories and, more specifically, to a Belt Sander Eraser Attachment.

2. Description of Related Art

Belt sanders, such as that depicted in FIG. 1, are a valued tool to the wood worker. The conventional belt sander 10 has a motor drive and roller mechanism housed within a housing 12. The sander 10 has a piece of reinforced sandpaper formed into a continuous loop (i.e. the sanding belt 14). The motor drive and roller drive the sanding belt 14 so that if the sander 10 is placed onto a workpiece on the bottom surface 17 of the belt, the workpiece will be sanded very quickly and evenly.

In order to control and direct the sander 10 while sanding, a front handle 16 and rear handle 15 are provided for the user to grasp onto. The sanding belts 14 come in a variety of grits and compositions to work on a wide variety of surfaces. The belt 14 is replaced by loosening the tension between the drive roller and the front roller 19, so that the belt 14 can be slid off the side.

The problem with the conventional belt sander 10 is that the belts 14 can tend to be quite costly. Frequent replacement of the belts as the sanding surface becomes clogged can be time-consuming as well as expensive. Frequently, there condition of a used sanding belt 14 is degraded, not because of a loss of the abrasive material from its surface, but rather because the abrasive surface has become clogged with cast-off material removed from the workpiece in the course of the sanding operation.

Over the years, craftspersons have discovered that much of the belt 14 clogging could be removed by running the belt 14 over a block of eraser-like material. While this approach works very well, it can be dangerous to work on the exposed (rapidly-moving belt) with the bare fingers, particularly when the eraser block shrinks in size due to normal usage wear. Also, it forces the user to cease sanding operations in order to "erase" the belt 14 before returning to work.

To solve these problems, what is needed is a belt sander eraser attachment that can be associated with a conventional sander 10, such that the belt 14 can be erased of clogging safely and without breaking from sanding operations.

SUMMARY OF THE INVENTION

In light of the aforementioned problems associated with the prior devices, it is an object of the present invention to provide a Belt Sander Eraser Attachment. The attachment should be configured to be attached to a conventional belt sander in order to provide the operator with the ability to remove built up sawdust and the like from the sanding belt. The device should replace the conventional front handle on a sander such that the new handle has functionality as both a handle and an actuator for the belt sander eraser. The eraser actuation should be convenient and ergonomically comfortable for the user while the sander is in use.

BRIEF DESCRIPTION OF THE DRAWINGS

The objects and features of the present invention, which are believed to be novel, are set forth with particularity in the appended claims. The present invention, both as to its organization and manner of operation, together with further objects and advantages, may best be understood by reference to the following description, taken in connection with the accompanying drawings, of which:

DETAILED DESCRIPTION OF THE PREFERRED EMBODIMENTS

The following description is provided to enable any person skilled in the art to make and use the invention and sets forth the best modes contemplated by the inventor of carrying out his invention. Various modifications, however, will remain readily apparent to those skilled in the art, since the generic principles of the present invention have been defined herein specifically to provide a Belt Sander Eraser Attachment.

Figure 1:
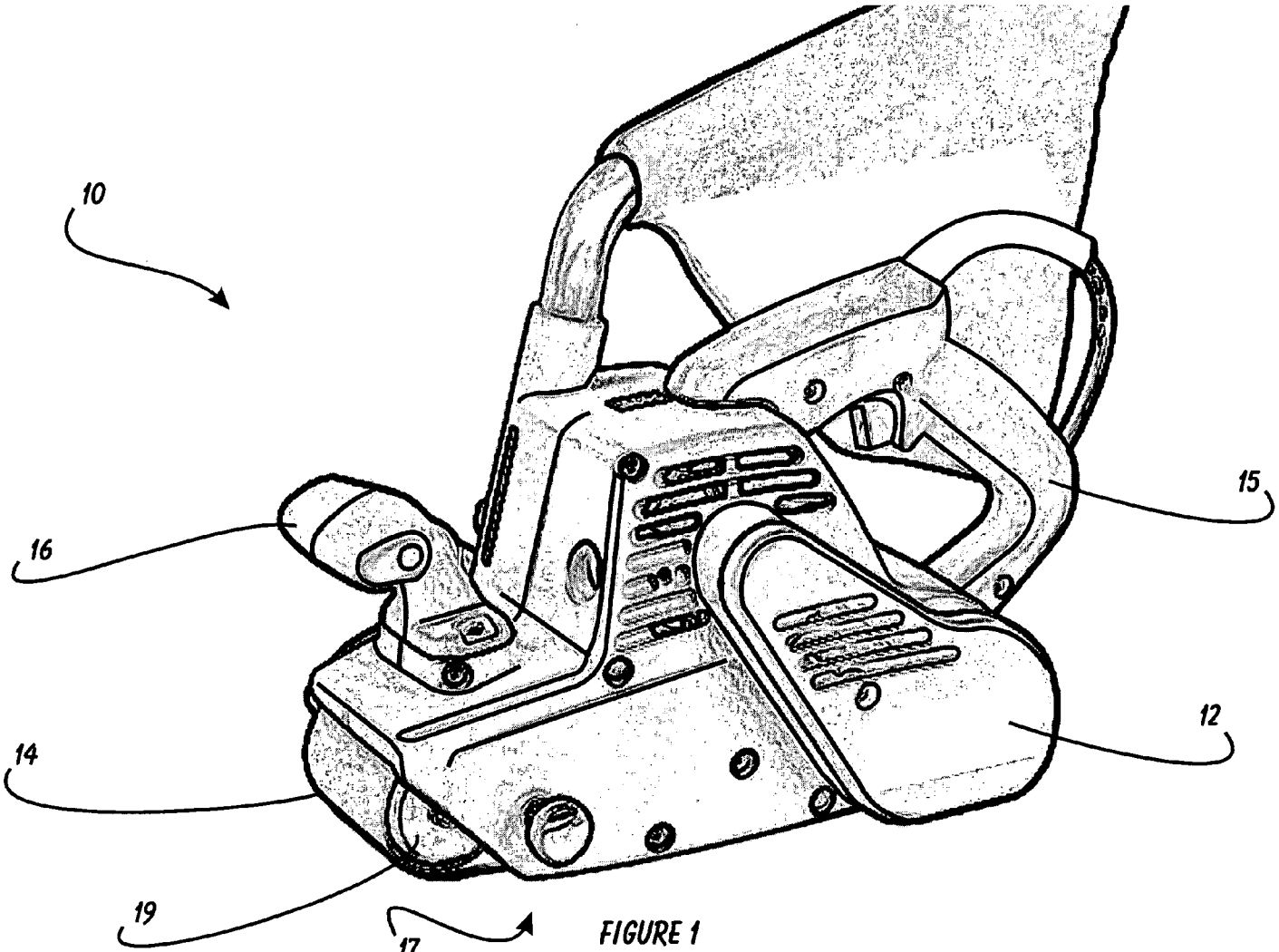
FIGURE 1 PRIOR ART
FIG. 1 is a perspective view of a conventional belt sander.
Figure 2:
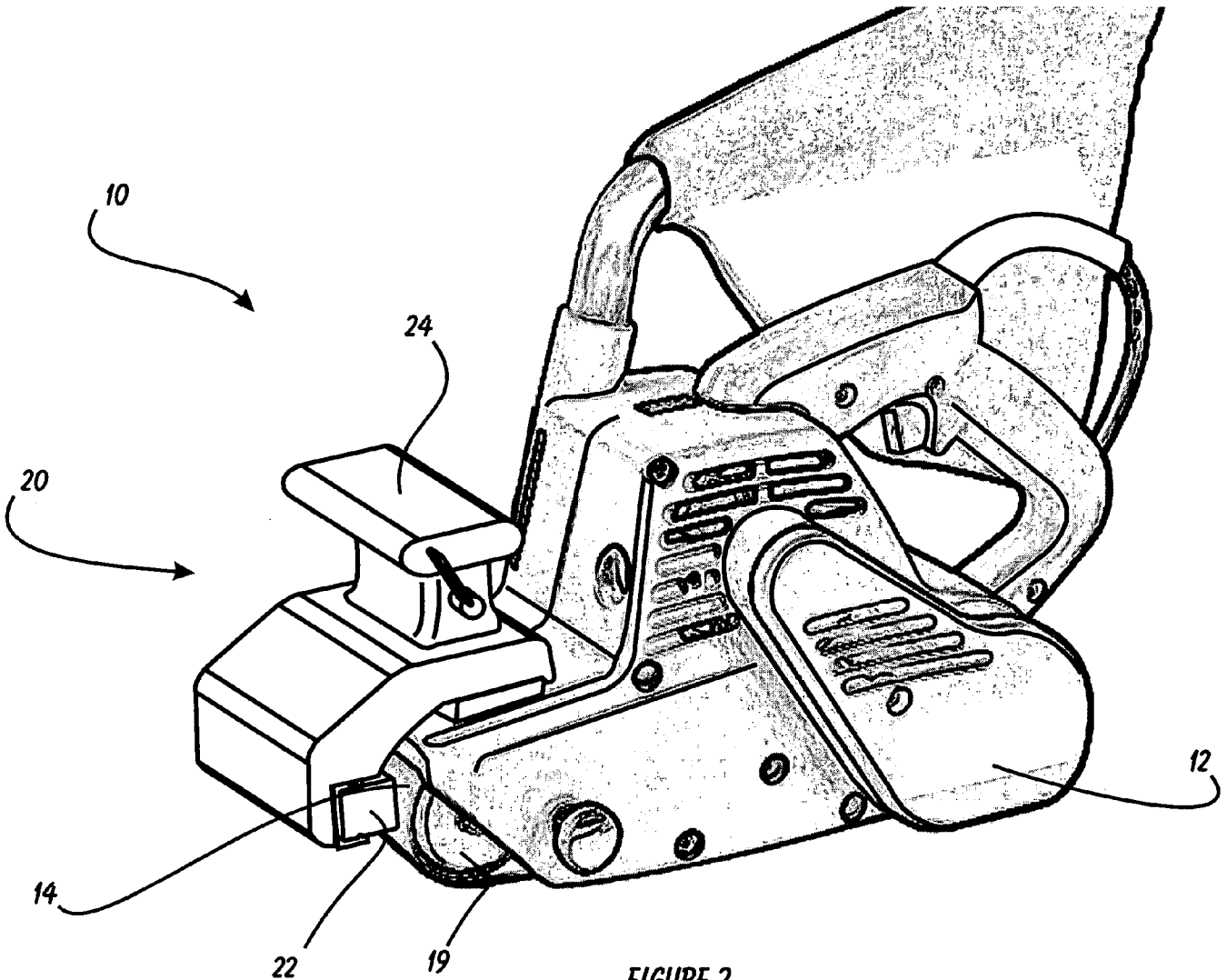
FIG. 2 is a perspective view of the sander of FIG. 1, having a preferred embodiment of the belt eraser attachment of the present invention attached thereto.

The present invention can best be understood by initial consideration of FIG. 2. FIG. 2 is a perspective view of the sander 10 of FIG. 1, having a preferred embodiment of the belt eraser attachment 20 of the present invention attached thereto. The attachment 20 is configured to attach to the housing 12 of the sander 10 in place of the front handle (see FIG. 1), on the forward deck of the sander 10 housing 12. The attachment 20 has its own integrated handle 24 (to replace the conventional handle), and it further has an actuatable belt eraser block 22 positioned in close proximity to the front roller 19. When the user actuates the device, the eraser block 22 will be pressed against the sanding belt 14, as the belt 14 passes around the front roller 19 (i.e. with the belt 14 is moving). When the belt 14 is sufficiently unclogged, the device is un-actuated, and the eraser block 22 is pulled back from the belt 14.

As should be apparent, there is no need for the user to put his or her fingers in harm's way. Furthermore, the belt 14 can be unclogged while the sander is in use, or at least without the user needing to set it down or reposition it to hold the old-fashioned eraser against the belt. If we now turn to FIG. 3, we can examine the functionality of the device in greater detail.

Figure 3:
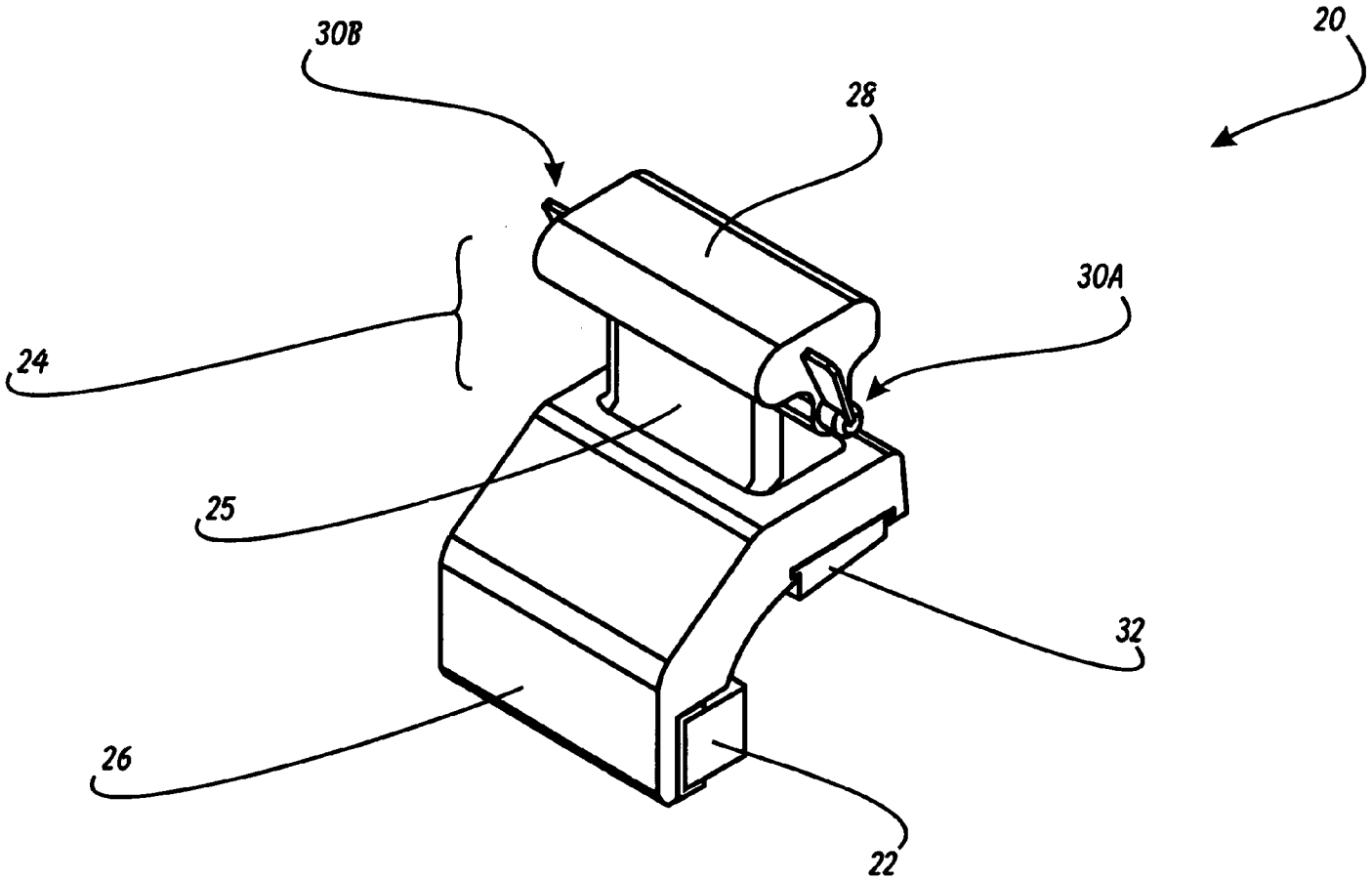
FIG. 3 is a perspective view of the attachment of FIG. 2.

FIG. 3 is a perspective view of the attachment 20 of FIG. 2. The attachment 20 has a handle 24 extending upwardly from the main housing 26. A handle cap 28 is removably attached to the top of the handle stem 25. Levers 30A and 30B extend outwardly from opposing sides of the handle 24. These levers 30A and 30B are actuated to cause the eraser block 22 to engage and disengage from the sanding belt.

The housing 26 is attached to the sander housing by a mounting pad 32. The mounting pad 32 holds the housing 26 in fixed relation to the sander housing. The eraser block 22, however, moves relative to the housing 26 (and sander housing) as will be described below in connection with FIG. 4.

Figure 4:
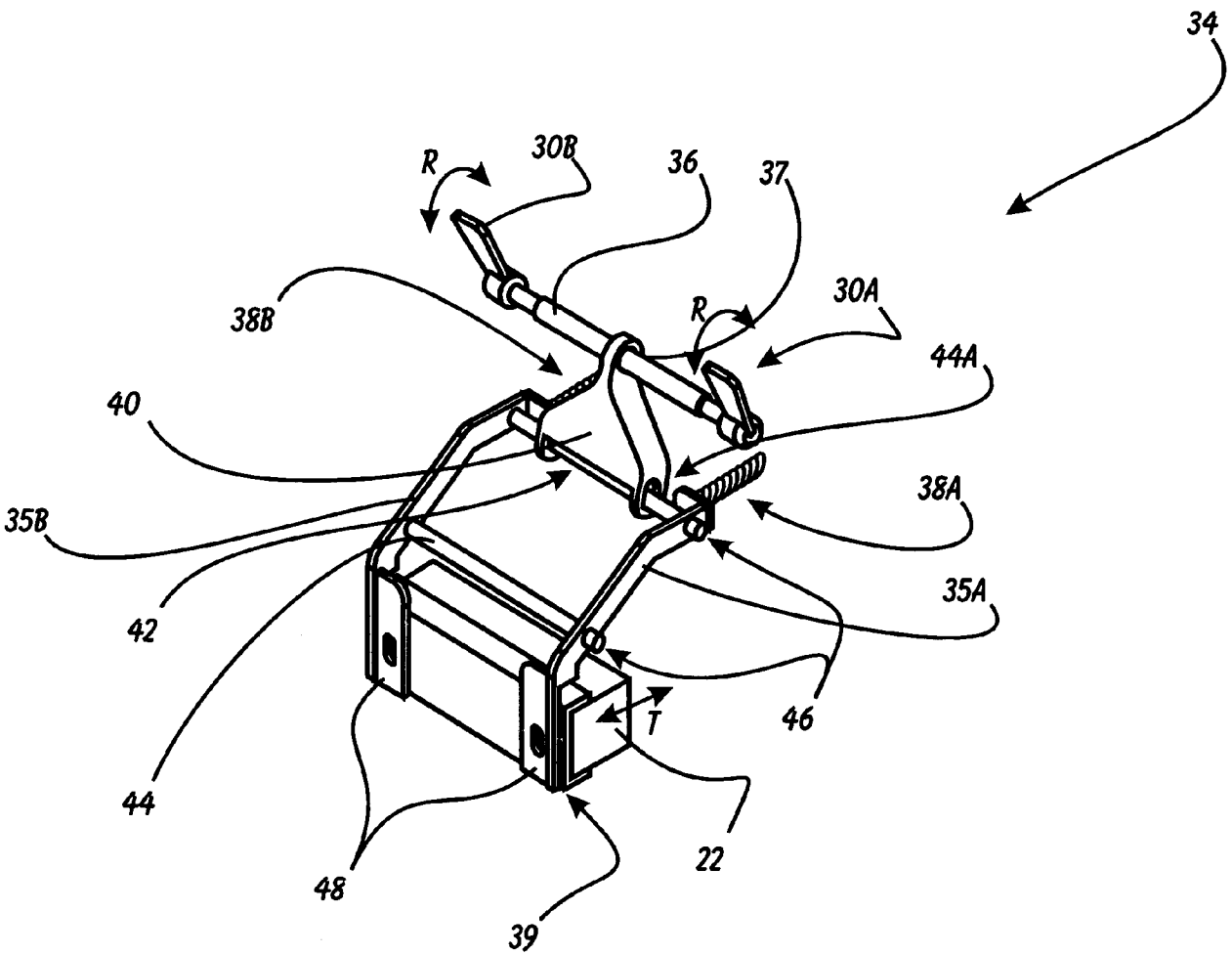
FIG. 4 is a perspective view of a preferred actuating assembly of the attachment of FIGS. 2 and 3.

FIG. 4 is a perspective view of a preferred actuating assembly 34 of the attachment of FIGS. 2 and 3. The assembly 34 has a pair of frame rails, 35A and 35B arranged in generally parallel spaced relation. An upper shaft 42 and a lower shaft 44 retain the first and second frame rails 35A and 35B to one another in a rigid fashion.

A cam arm 40 is retained to the assembly 34 by the upper shaft 42. The upper shaft 42 passes through a pair of coaxially arranged, elongate shaft slots (e.g. 44A), such that the cam arm 40 can freely rotation around the engagement between the slots (e.g. 44A) and the upper shaft 42. At its opposite end, an axle bore 37 is formed through the cam arm 40 to permit lever axle 36 to pass therethrough. The lever axle 36 is fixedly retained within the axle bore 37, such that rotation of the lever axle 36 (i.e. axial rotation) will cause the cam arm 40 to also rotate around the lever axle's axis. The levers 30A and 30B previously discussed in connection with FIG. 3 extend outwardly from opposing ends of the lever axle 36.

At the lower ends of each frame rail 35A and 35B, a mounting plate 48 is provided for attaching the belt eraser 22. The eraser 22 is partially encased in a retainer 39, which is in turn attached to the mounting plates 48. The retainer 39 is to be a U-shaped part crimped onto the forward end of the eraser 22.

Near the upper ends of each of the frame rails 35A and 35B, a pair of matched springs 38A and 38B extend backwardly (i.e. towards the sander then the device is installed). These springs 38A and 38B are designed to press against the inner rear surface of the housing of the attachment (see FIG. 3) such the they bias the frame rails 35A and 35B away from the housing in a forward direction (i.e. away from the sander).

There are a pair of guide pins 46 extending outwardly from the outer surfaces of each of the frame rails 35A and 35B. These may be simply extensions of the opposing ends of the upper and lower shaft 42 and 44, or they may be elements that are separate from the shafts 42 and 44. The guide pins 46 serve to cooperate with the housing (see FIG. 3) such that when the levers 30A and 30B are rotated in direction "R", the cam arm 40 will drive the frame rails 35A and 35B and therefore the eraser 22 to move in a translational motion in direction "T." The specific way that these guide pins accomplish this is discussed below in connection with FIG. 5.

Figure 5:
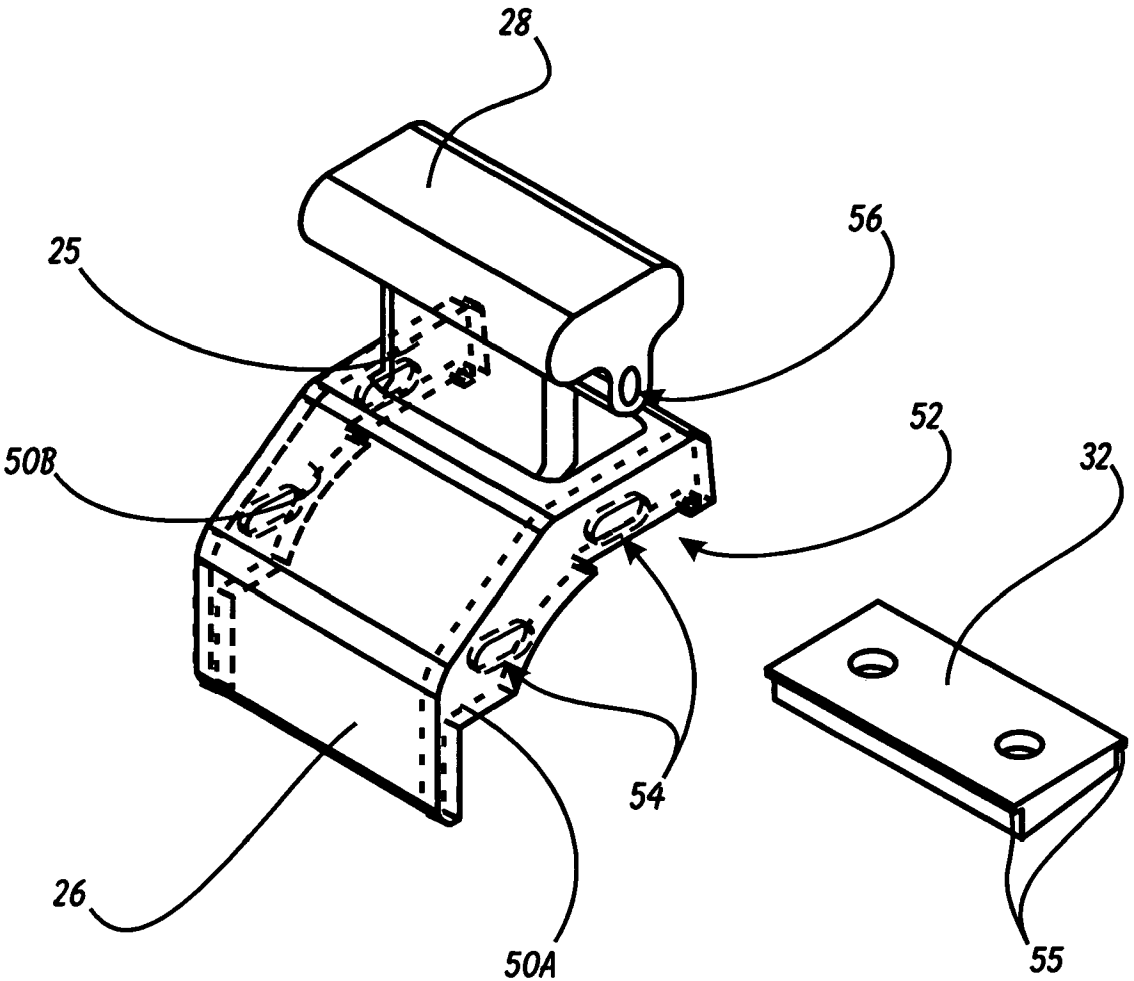
FIG. 5 is an exploded partial perspective view of the housing and mounting pad of the attachment of FIGS. 2–4.

FIG. 5 is an exploded partial perspective view of the housing and mounting pad of the attachment of FIGS. 2–4. The mounting pad 32 has slots or holes formed through it so that it can be attached to the front deck of the sander housing using the same mounting screws or bolts that were used to attach the original equipment handle thereto. The mounting pad 32 is further provided with a pair of opposing fins 55 running the (transverse) width of the mounting pad 32 such. The mounting fins 55 are designed to cooperate with a mounting channel 52 formed in the housing 26 of the attachment.

The T-shaped mounting channel 52 allows the housing 26 to be slid onto the mounting pad 32 once the mounting pad 32 has been attached to the sander housing.

As shown in hidden lines, the housing 26 is generally hollow in order to accommodate the actuating assembly of FIG. 4 therein. The housing 26 as first and second sidewalls 50A and 50B defining the two generally parallel sides of the housing 26. Each sidewall 50A and 50B has a pair of pin slots 54 cut into their inner surfaces. The pin slots 54 are located and otherwise configured to cooperate with the pin guides (see FIG. 4) to allow the actuating assembly (see FIG. 4) to slide forward and back in relation to the fixed housing 26.

The handle cap 28 can be removed from the handle stem 25 for assembly/disassembly of the device. The handle stem 25 is also hollow to accommodate the upper portion of the actuating assembly (see FIG. 4) therein. A pair of opposing handle bores (e.g. 56) are formed in the handle cap 28 through which the lever axle (see FIG. 4) can pass and be allowed to rotate freely.

Those skilled in the art will appreciate that various adaptations and modifications of the just-described preferred embodiment can be configured without departing from the scope and spirit of the invention. Therefore, it is to be understood that, within the scope of the appended claims, the invention may be practiced other than as specifically described herein.

What is claimed is:

1. A sandpaper belt eraser attachment, comprising:
an actuating assembly comprising:
at least one rotatable lever extending from a lever axle, said lever axle defining a central axis;
an eraser block; and
at least one frame rail interconnecting said at least one lever and said eraser block, whereby rotating said lever causes lever axle to rotate about said central axis to drive said eraser block to move in a planar fashion relative to said lever, said planar fashion comprising translational movement.

2. The attachment of claim 1, wherein said actuating assembly comprises a pair of said frame rails, each said frame rail arranged in spaced relation and interconnected by at least one shaft.

3. The attachment of claim 2, wherein said actuating assembly comprises an upper said shaft and a lower said shaft, and further comprises a cam arm defined by a pair of coaxial shaft slots, said upper shaft passing through said shaft slots, said at least one lever associated with said cam arm.

4. The attachment of claim 3, wherein said actuating assembly further comprises a lever axle passing through an axle bore formed in said cam arm, one said lever attached to each opposing end of said lever axle.

5. The attachment of claim 4, wherein said frame rails define an upper end adjacent to said upper shaft and a lower end comprising a pair of mounting plates located thereon, said eraser block attached to said mounting plates.

6. The attachment of claim 5, wherein said frame rails each define outer surfaces, said actuating assembly further comprising a plurality of guide pins extending outwardly from said outer surfaces.

7. The attachment of claim 6, further comprising a housing within which said frame rails are retained, said housing defined by a main housing, a handle stem and a removable handle cap.

8. The attachment of claim 7, wherein said main housing is defined by side walls having inner surfaces, said inner surfaces defined by a plurality of pin slots formed therein to cooperate with said guide pins to cause said frame rails to be restrained in its permissible travel to said planar fashion.

9. A combination, comprising:
a belt sander defined by a housing, a front roller protruding from a front area of said housing and a sanding belt passing over said front roller; and
a sandpaper belt eraser attachment, comprising:
a housing attached to said belt sander housing generally above said front roller; and
an actuating assembly comprising:
a lever axle defining a central axis and opposing ends;
at least one rotatable lever extending from a said end of said axle;
an eraser block; and at least one frame rail interconnecting said lever axle, whereby rotating said lever axle about said central axis causes said eraser block to move in a planar fashion relative to said lever axle to contact said sanding belt as it passes over said front roller, said planar fashion defined as translational motion in a flat spacial plane either towards or away from said sanding belt.

10. The combination of claim 9, wherein said sandpaper belt eraser attachment further comprises a mounting pad attached to said belt sander housing generally above said front roller, said sandpaper belt eraser attachment housing attached to said mounting pad.

11. The combination of claim 10, wherein said actuating assembly comprises an upper said shaft and a lower said shaft, and further comprises a cam arm defined by a pair of coaxial shaft slots, said upper shaft passing through said shaft slots, said at least one lever associated with said cam arm.

12. The combination of claim 11, wherein said actuating assembly comprises a pair of said frame rails, each said frame rail arranged in spaced relation and interconnected by at least one shaft.

13. The combination of claim 12, wherein said actuating assembly further comprises a lever axle passing through an axle bore formed in said cam arm, one said lever attached to each opposing end of said lever axle.

14. The combination of claim 13, wherein said frame rails define an upper end adjacent to said upper shaft and a lower end comprising a pair of mounting plates located thereon, said eraser block attached to said mounting plates.

15. The combination of claim 14, wherein said frame rails each define outer surfaces, said actuating assembly further comprising a plurality of guide pins extending outwardly from said outer surfaces.

16. The combination of claim 15, wherein said main housing is defined by side walls having inner surfaces, said inner surfaces defined by a plurality of pin slots formed therein to cooperate with said guide pins to cause said frame rails to be restrained in its permissible travel to said planar fashion.

17. An attachment for belt sander devices, comprising:

a housing;

an actuating assembly retained in said housing, comprising:

a lever axle defining a central axis of rotation and a pair of opposing ends;

a pair of levers each said lever extending from one said end of said lever axle whereby actuation of either said lever causes said lever axle to rotate about said central axis;

an eraser block; and a pair of frame rails interconnecting said levers axle and said eraser block, whereby actuating either of said levers causes said eraser block to move in a planar fashion relative to said levers, said planar fashion defined by movement in a translational fashion in a spacially flat plane.

* * * * *